US008118452B2

(12) United States Patent
Leary et al.

(10) Patent No.: US 8,118,452 B2
(45) Date of Patent: Feb. 21, 2012

(54) SEARCHLIGHT HAVING ROTATIONAL BEAM FOCUS FOR MARINE APPLICATIONS

(75) Inventors: Kevin Joseph Leary, Hamilton, MA (US); Samuel Hinckley, Nashua, NH (US); Robert King, South Hamilton, MA (US); Kenneth J. LeBlanc, Gloucester, MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 308 days.

(21) Appl. No.: 12/554,190

(22) Filed: Sep. 4, 2009

(65) Prior Publication Data

US 2010/0118539 A1 May 13, 2010

Related U.S. Application Data

(60) Provisional application No. 61/096,107, filed on Sep. 11, 2008.

(51) Int. Cl.
*F21V 19/02* (2006.01)

(52) U.S. Cl. ..... 362/285; 362/287; 362/418

(58) Field of Classification Search ..... 362/285, 362/418, 287

See application file for complete search history.

(56) References Cited

U.S. PATENT DOCUMENTS

| | | | | |
|---|---|---|---|---|
| 2,115,982 | A | | 5/1938 | Worden |
| 3,634,677 | A | | 1/1972 | Wolffing-Seelig et al. |
| 3,979,649 | A | | 9/1976 | Persha |
| 3,987,296 | A | | 10/1976 | Coppola et al. |
| 4,353,110 | A | | 10/1982 | Ellis |
| 4,386,391 | A | | 5/1983 | Gulliksen et al. |
| 4,578,575 | A | | 3/1986 | Roos |
| 4,709,305 | A | | 11/1987 | McMahan et al. |
| 4,935,853 | A | * | 6/1990 | Collins ..... 362/272 |
| 5,030,886 | A | | 7/1991 | Darrow |
| 5,228,770 | A | | 7/1993 | Brunson |
| 5,490,046 | A | | 2/1996 | Gohl et al. |
| 5,589,901 | A | | 12/1996 | Means |
| 5,695,272 | A | | 12/1997 | Snyder et al. |

(Continued)

FOREIGN PATENT DOCUMENTS

| | | |
|---|---|---|
| EP | 1124090 | 8/2001 |
| EP | 1650078 | 4/2006 |
| EP | 1683720 | 7/2006 |

OTHER PUBLICATIONS 4 pages PCT/US09/56003 International Search Report mailed Nov. 3, 2009.

4 pages PCT/US09/55993 International Search Report mailed Nov. 10, 2009.

*Primary Examiner* — Stephen F Husar
*Assistant Examiner* — James Cranson, Jr.

(57) ABSTRACT

A searchlight is provided featuring a searchlight having a searchlight assembly and a searchlight control circuitry module. The searchlight assembly has a central axis and includes a ramped insert and a light source socket arrangement. The ramped insert is configured with an angled surface that is oblique in relation to the central axis. The light source socket arrangement is configured to receive a bulb or light source for providing the light beam, is also configured with a corresponding angled surface that is also oblique in relation with to the central axis, and is also configured to respond to an applied force and rotate so as to move axially along the central axis in relation to the ramped insert.

25 Claims, 10 Drawing Sheets

U.S. PATENT DOCUMENTS 5,806,956 A 9/1998 Hyun-Jo
6,609,812 B2 8/2003 Machi et al.
6,786,622 B1 * 9/2004 Rice ..... 362/362
7,011,439 B1 3/2006 Kane
7,044,623 B2 5/2006 Olsson et al.
7,452,108 B2 * 11/2008 Gordin et al. ..... 362/285
2006/0087839 A1 4/2006 Yuen
2006/0158887 A1 7/2006 Holder et al.

* cited by examiner

SEARCHLIGHT HAVING ROTATIONAL BEAM FOCUS FOR MARINE APPLICATIONS

CROSS-REFERENCE TO RELATED APPLICATIONS

This application claims benefit to provisional patent application Ser. No. 61/096,107, filed 11 Sep. 2008, which is hereby incorporated by reference in its entirety.

This application is also related to patent application Ser. No. 12/554,190 entitled "Searchlight Having Pull-in Bezel Retention for Marine Applications," filed concurrently herewith, which is also hereby incorporated by reference in its entirety.

BACKGROUND OF THE INVENTION

1. Field of the Invention

This invention relates to a searchlight; more particularly, relates to a searchlight having an adjustable light beam.

2. Description of Related Art

Searchlights are known in the art.

For example, U.S. Pat. No. 3,987,296 discloses a searchlight having a threaded aperture means for axially moving a bulb in relation to a parabolic reflector. The '296 patent also discloses that the searchlight is a remote controlled motor driven searchlight, which comprises a scissors linkage directing beam, and focusing motor varying lamp and reflector spacing and the switch means is a single multi-positioned rotatable "joy-stick".

EP 1124090 discloses a focus control for search lights, which comprises a rotary focus device which may be narrowed or widened by rotating a bidirectional focus control cam in a clockwise or counterclockwise direction as selected by a manually operated three-position control switch and which determines the rotational direction of a DC motor driving the bidirectional focus control cam.

Some known flashlights and work lamps appear to utilize some angled rotational surface techniques.

However, only a limited number of marine searchlights have beam focusing. Focus capability in these products has been produced by mounting a bulb or bulbs on a carriage that could then be translated relative to the reflector(s). This known technique appears to be bulky and requires a substantial actuation force. Further, many manufacturers of searchlights in the market offer spot/flood beam, but none offer "progressive" focusing from a spot beam to a flood beam.

SUMMARY OF THE INVENTION

The present invention provides a new and unique searchlight featuring a searchlight assembly and a searchlight control circuitry module. The searchlight assembly having a central axis, and also having a ramped insert and a light source socket arrangement. The ramped insert is configured with an angled surface that is oblique in relation to the central axis. The light source socket arrangement is configured to receive a bulb or light source for providing a light beam, is configured with a corresponding angled surface that is also oblique in relation to the central axis, and is also configured to respond to an applied force and rotate so as to move axially along the central axis in relation to the ramped insert.

According to some embodiments of the present invention, the light source socket arrangement is configured to include a bulb or light source socket and a ramped collar, including where the bulb or light source socket is fixedly coupled to the ramped collar, or where the ramped collar is configured with the corresponding angled surface, or where the bulb or light source socket is configured to receive the bulb or light source and to respond to the force, or some combination thereof.

According to some embodiments of the present invention, the searchlight assembly is also configured with a reflector being arranged in relation to the ramped insert and the light source socket arrangement, such that the movement of the light source socket arrangement axially along the central axis in relation to the ramped insert focuses the light beam in relation to the reflector.

According to some embodiments of the present invention, the movement of the light source socket arrangement axially along the central axis in relation to the ramped insert causes the bulb or light source arrangement to move in relation to the reflector that enables the degree of focus of a light beam emanating from the bulb or light source to change by moving the bulb or light source arrangement in and out along the central axis of the reflector, including so as to provide progressive spot-to-flood focusing, and vice versa.

According to some embodiments of the present invention, in response to the force, the corresponding angled surface of the light source socket arrangement is configured to slide in relation to the angled surface of the ramped insert, causing the light source socket arrangement to move axially along the central axis in relation to the ramped insert.

According to some embodiments of the present invention, the searchlight further may feature a housing or chassis, and the ramped insert is fixedly coupled to the housing or chassis.

According to some embodiments of the present invention, the light source socket arrangement is configured to receive a transverse rotational force applied in relation to the central axis and move in an axial translation along the central axis.

According to some embodiments of the present invention, the searchlight assembly is configured as a dual beam configuration, where each beam configuration comprises a respective ramped insert and a respective light source socket arrangement as described above.

According to some embodiments of the present invention, the dual beam configuration is configured with a central actuator and linkage that is configured to focus two parallel beams simultaneously to position and synchronize respective light source socket arrangements in relation to respective ramped inserts.

According to some embodiments of the present invention, the one or more modules of the searchlight control circuitry module is configured to receive the signaling from a control module of a searchlight controller.

According to some embodiments of the present invention, the one or more modules of the searchlight control circuitry module is also configured to provide the corresponding signaling to the searchlight assembly, including providing a signal for controlling a motor that forms part of the searchlight assembly and provides the rotational force.

According to some embodiments, the present invention may also take the form of a new and unique searchlight assembly having in combination such a ramped insert and such a light source socket arrangement, as described above.

According to some embodiments, the present invention may also take the form of a new and unique searchlight control circuitry module having one or more such modules configured to perform the circuitry functionality set forth herein.

The searchlight according to the present invention may be the first marine searchlight to use a ramped bulb holder to produce an axial translation of a light source.

Moreover, the searchlight according to the present invention appears to be the first known application of any kind to utilize two ramped bulb-holders in a dual-beam configuration, where two parallel beams are focused simultaneously using a central actuator and flexible linkage to position and synchronize the ramped collars.

With this feature, the new searchlight according to the present invention will be the only recreational marine searchlight to offer progressive spot-to-flood focusing. On a marine vessel, a spot mode of operation is best used for illumination and identification of distant objects. As the beam angle progresses from the spot mode of operation toward a flood mode of operation, progressively greater peripheral visibility at shorter distances from the marine vessel is acquired. This is especially useful while underway in a crowed harbor or channel where the boater can select the optimal beam distance and beam width to maximize operating safety.

These and other features, aspects, and advantages of embodiments of the invention will become apparent with reference to the following description in conjunction with the accompanying drawings. It is to be understood, however, that the drawings are designed solely for the purposes of illustration and not as a definition of the limits of the invention.

BRIEF DESCRIPTION OF THE DRAWING

The drawing, which is not necessarily to scale, include the following Figures.

In the following description of the exemplary embodiment, reference is made to the accompanying drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIGS. 1 to 4*b* show various features and aspects of a new and unique searchlight according to some embodiments of the present invention. The description is provided by way of example, is not intended to be limiting, and is intended to include modifications within the spirit of the underlying invention using alternative features, elements, or other suitable technology that is either now known or later developed in the future.

FIGS. 1*a*-1*d*: The Rotational Beam Focus

Figure 1:
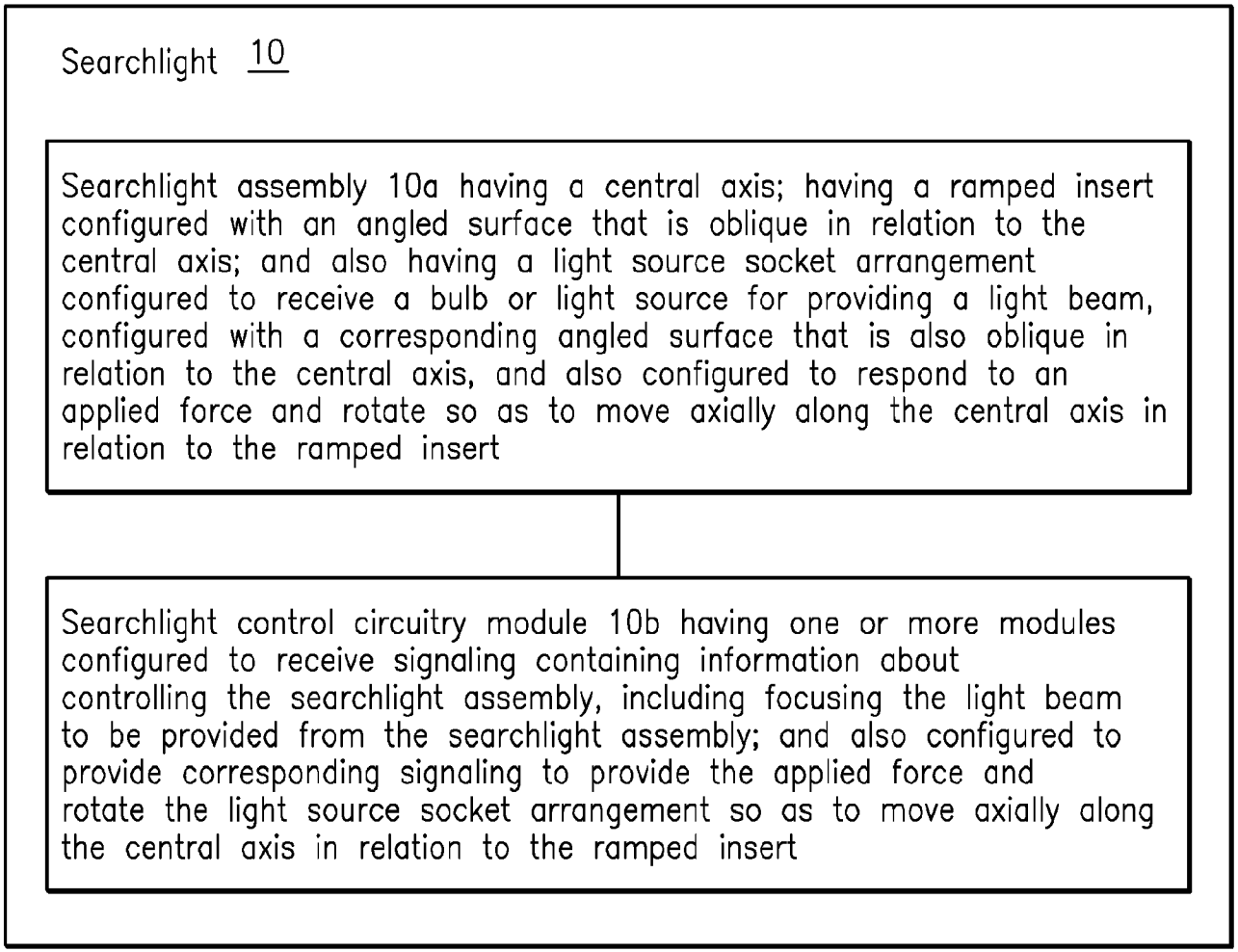
FIG. 1 shows a clock diagram of a searchlight according to some embodiments of the present invention.

In FIG. 1, the searchlight 10 features a searchlight assembly 10*a* in combination with a searchlight control circuitry module 10*b* for implementing a rotational beam focus according to some embodiments of the present invention. By way of example, FIGS. 1*a*, 1*b*, 1*c* and 1*d* show basic features of according to some embodiments of the present invention, while the remaining FIGS. 2*a*-4*b* show other features and aspects of other inventions that form part of other related applications.

FIGS. 1*a*-1*d*: The Searchlight Assembly 10*a*

Figure 1A:
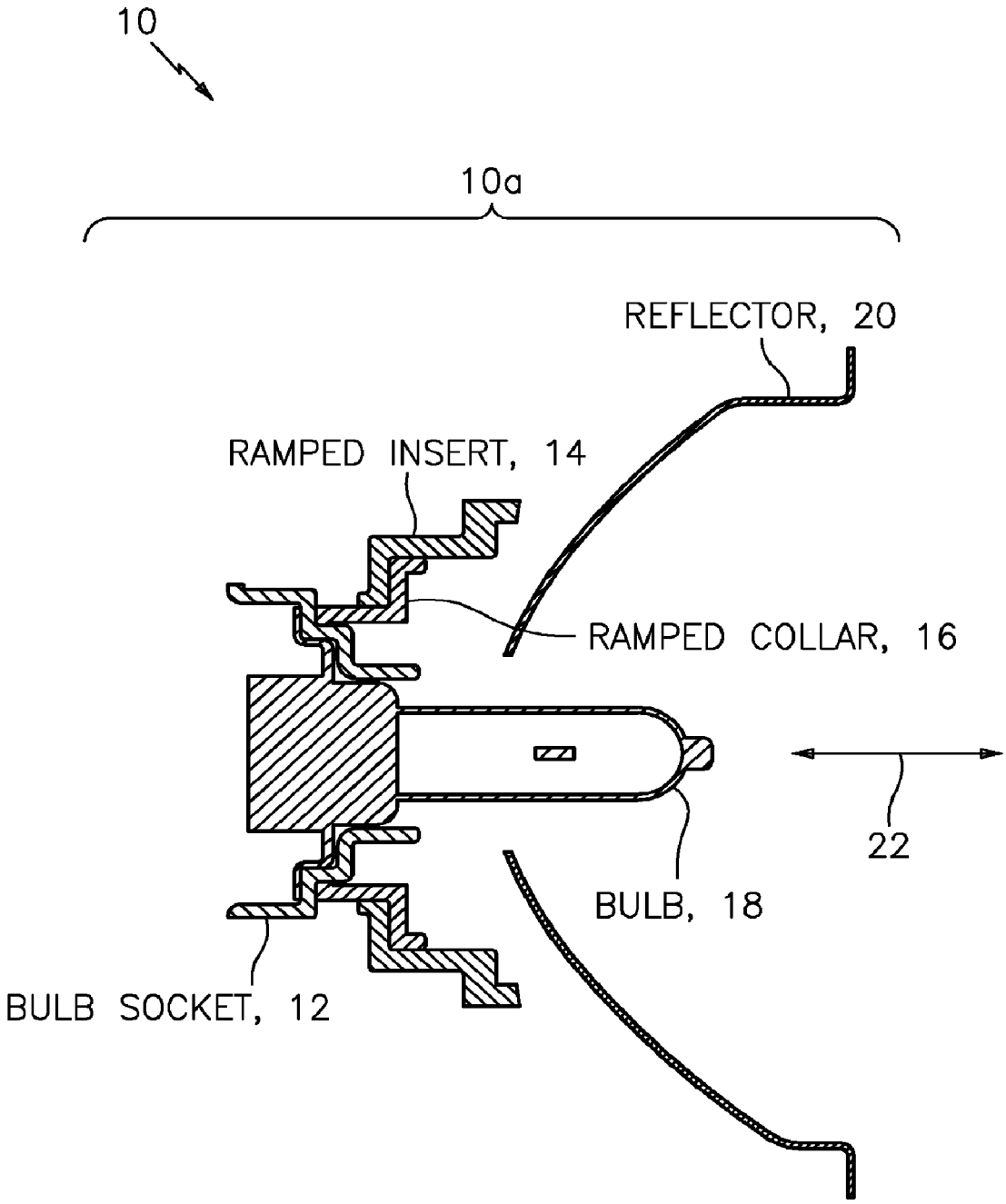
FIG. 1*a* shows a diagram of a bulb socket, a ramped insert, a ramped collar, a bulb and a reflector that form part of a searchlight assembly of the searchlight shown in FIG. 1 according to some embodiments of the present invention.
Figure 1B:
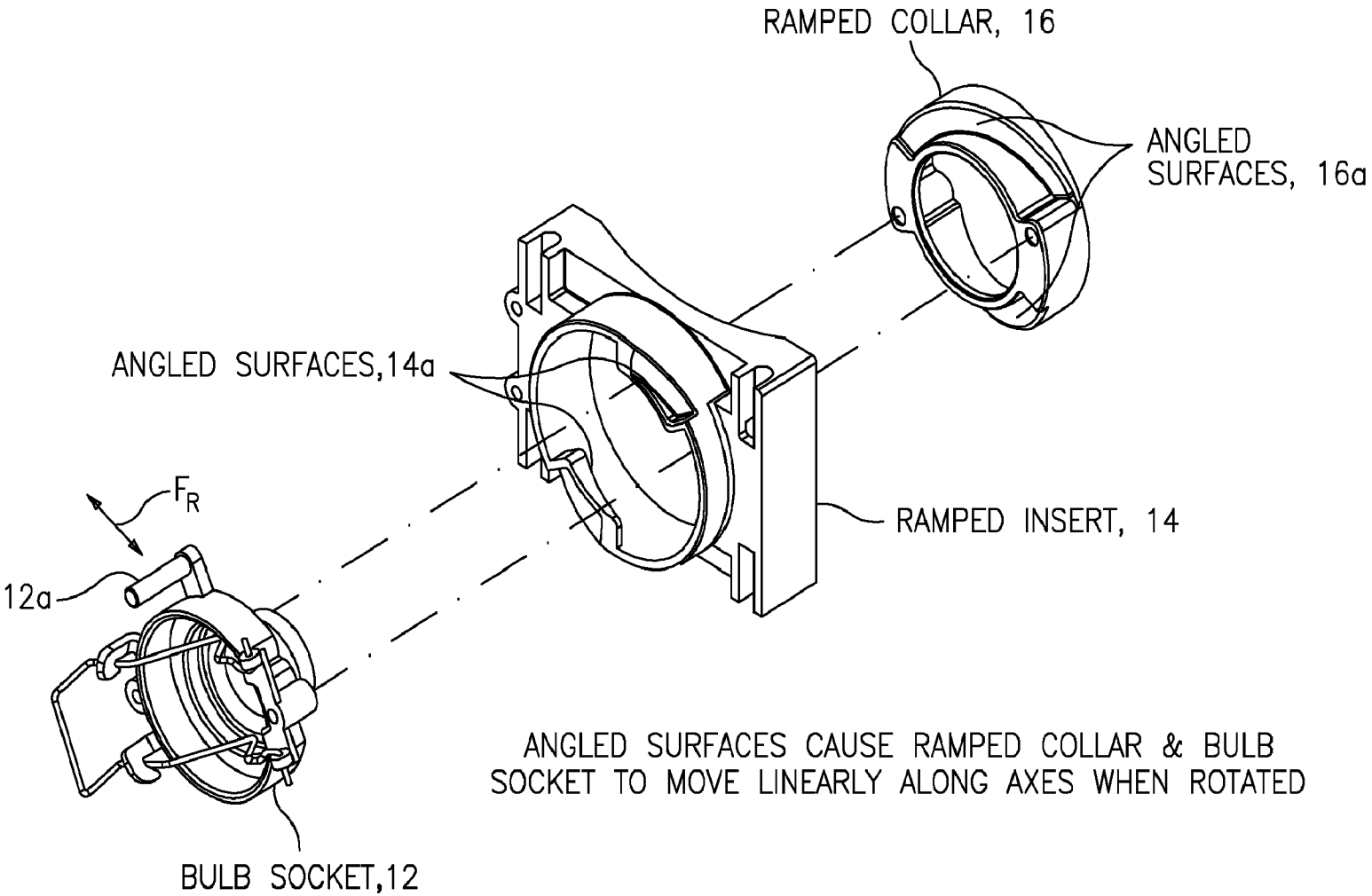
FIG. 1*b* shows an exploded view of a bulb socket, a ramped insert and a ramped collar that form part of a searchlight assembly of the searchlight shown in FIG. 1 according to some embodiments of the present invention.

In particular, FIGS. 1*a* and 1*b* show a bulb socket 12, a ramped insert 14, a ramped collar 16, a bulb or light source 18 and a reflector 20 that form part of the searchlight assembly 10*a* of the searchlight 10 according to some embodiments of the present invention. As shown, the searchlight assembly 10*a* has a central axis generally indicated by arrow 22. The searchlight assembly 10*a* and searchlight 10 also include other features that do not form part of the underlying invention disclosed and claimed herein, including features disclosed below in relation to FIGS. 2*a* to 4*b*.

The searchlight assembly 10*a* also includes a light source socket arrangement 12, 16 that is formed by the combination of the light socket 12 and the ramped collar 16.

The ramped insert 14 is configured with one or more angled surfaces 14*a* that are obliquely curved in relation to the central axis 22.

The light source socket arrangement 12, 16 is configured to receive the bulb or light source 18, and is also configured with one or more corresponding angled surfaces 16*a* that are also obliquely curved in relation with to the central axis 22.

In operation, the light source socket arrangement 12, 16 is configured to respond to an applied force, e.g., a rotational force $F_R$ (see FIG. 1*b*), applied in relation to the central axis 22 and rotate so as to move axially along the central axis 22 in relation to the ramped insert 14. As shown, the rotational force $F_R$ (FIG. 1*b*) is applied substantially traverse to the central axis 22, and the axial movement of the light source socket arrangement 12, 16 is substantially parallel to the central axis 22. The rotational force $F_R$ may be applied to a pivot rod 12*a* extending from the bulb or light source socket 12 (See also FIG. 1*c*), although the scope of the invention is intended to include other configurations for applying the force and rotating the light source socket arrangement 12, 16 in relation to the ramped insert 14 in order to move axially along the central axis 22 the light source socket arrangement 12, 16 in relation to the ramped insert 14 that are either now known or later developed in the future.

In response to the rotational force $F_R$, the corresponding angled surface 16*a* of the ramped collar 16 of the light source socket arrangement 12, 16 slides on, or in relation to, the angled surface 14*a* of the ramped insert 14, causing the light source socket arrangement 12, 16 to rotate and move axially along the central axis 22 in relation to the ramped insert 14.

The light source socket arrangement 12, 16 may be configured so that the bulb or light source socket 12 is fixedly coupled to the ramped collar 16, by, for example, rods/bolts and nuts (not shown), according to some embodiments of the present invention. The scope of the invention is not intended to be limited to the type, kind or ways of coupling the bulb or light source socket 12 and the ramped collar 16, including types, kinds or ways either now known or later developed in the future.

The searchlight assembly 10*a* may also include a housing or chassis 30 (FIG. 1*c*), and the ramped insert 16 may be fixedly coupled to the housing or chassis 30 with bolts 32, according to some embodiments of the present invention.

The bulb or light source socket 12 may be configured to receive the rotational force $F_R$ as a transverse rotational force applied in relation to the central axis, so as to rotate and move in an axial translation along the central axis 22, according to some embodiments of the present invention.

The searchlight assembly may also comprise a reflector 20 that is configured and arranged in relation to the central axis 22 for focusing the light beam, according to some embodiments of the present invention. For example, the movement of the bulb or light source 18 and the light socket arrangement 12, 16 axially along the central axis 22 in relation to the ramped insert 14 causes the bulb or light source 18 to move in relation to the reflector 20 that enables the degree of focus of a light beam emanating from the bulb or light source 18 to change by moving the bulb or light source 18 in and out along the central axis 22 of the reflector 20, including so as to provide progressive spot-to-flood focusing, and vice versa, according to some embodiments of the present invention.

Figure 1C:
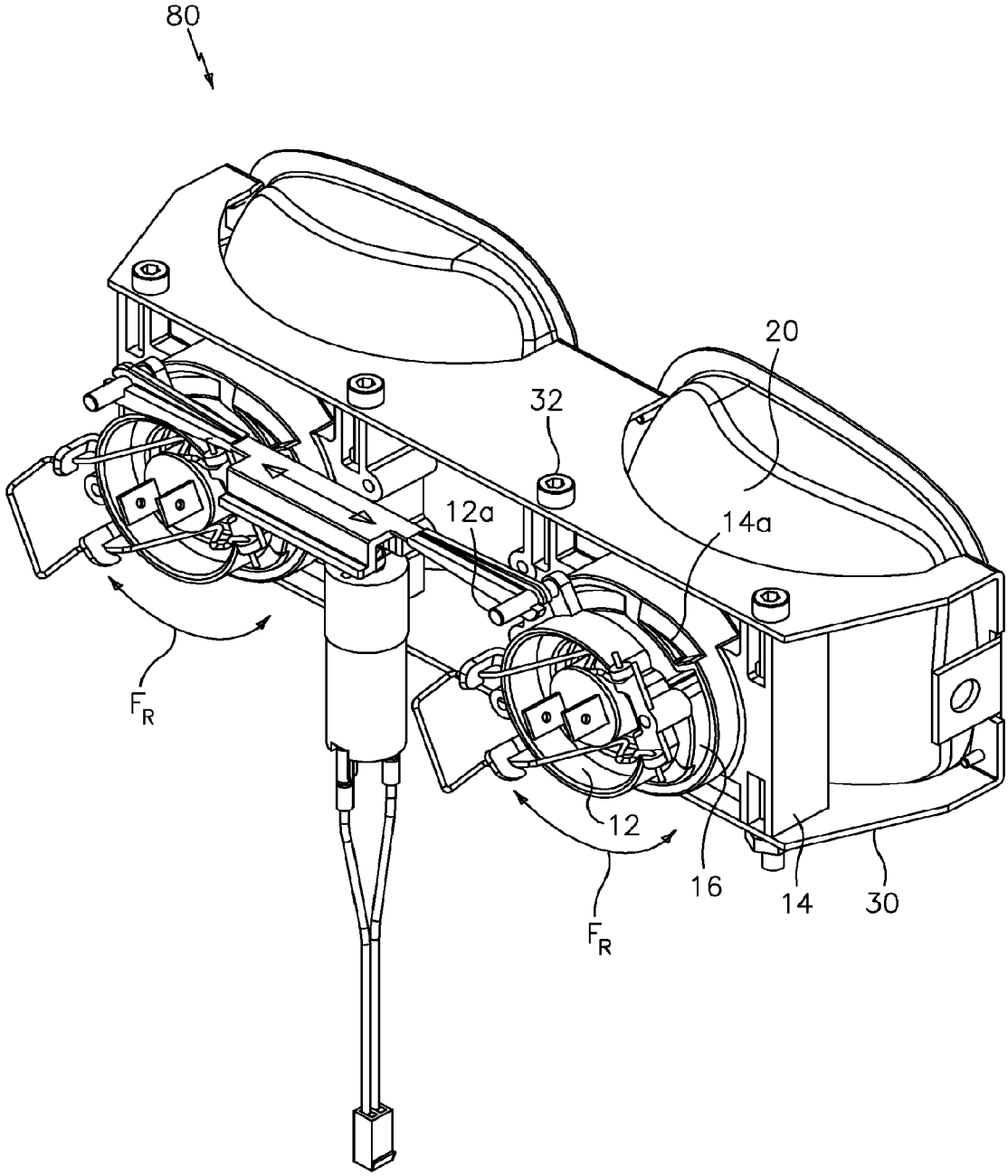
FIG. 1*c* shows a view of a dual beam configuration of a searchlight assembly of the searchlight shown in FIG. 1 according to some embodiments of the present invention.

FIG. 1*c*: The Dual-Beam Configuration

FIG. 1*c* shows a searchlight generally indicated as 90 having two searchlight assembly that together form of a dual beam configuration, where each searchlight assembly includes a respective central axis, a respective ramped insert and a respective light source socket arrangement, consistent with that described above. In FIG. 1*c*, similar elements are labeled with similar reference numerals as shown in FIG. 1*a*, 1*b*. The dual beam configuration in FIG. 1*c* may also comprise a central actuator and linkage 40 configured to focus two parallel beams simultaneously to position and synchronize respective ramped collars, according to some embodiments of the present invention. FIG. 1*c* includes other features or devices that do not form part of the underlying invention. Moreover, the functionality of such other features or devices is, or would be, known in the art, and are not described in detail herein.

In effect, FIGS. 1*a*, 1*b* and 1*c* show a rotational beam focus feature according to some embodiments of the present invention, that enables the degree of focus of the light beam to be changed by moving the bulb or light source 18 in and out, along the central axis 22 of, or in relation to, the reflector 20 (See FIG. 1*a*). By way of example, one technique of controlling this motion is to mount the bulb or light source on, or in relation to, the light socket arrangement 12, 16, which includes bulb or light socket 12 and the ramped collar 16; allowing the user to rotate the bulb socket arrangement or chassis 12, 16 to change the axial position of the bulb or light source 18 relative to the reflector 20.

Figure 1D:
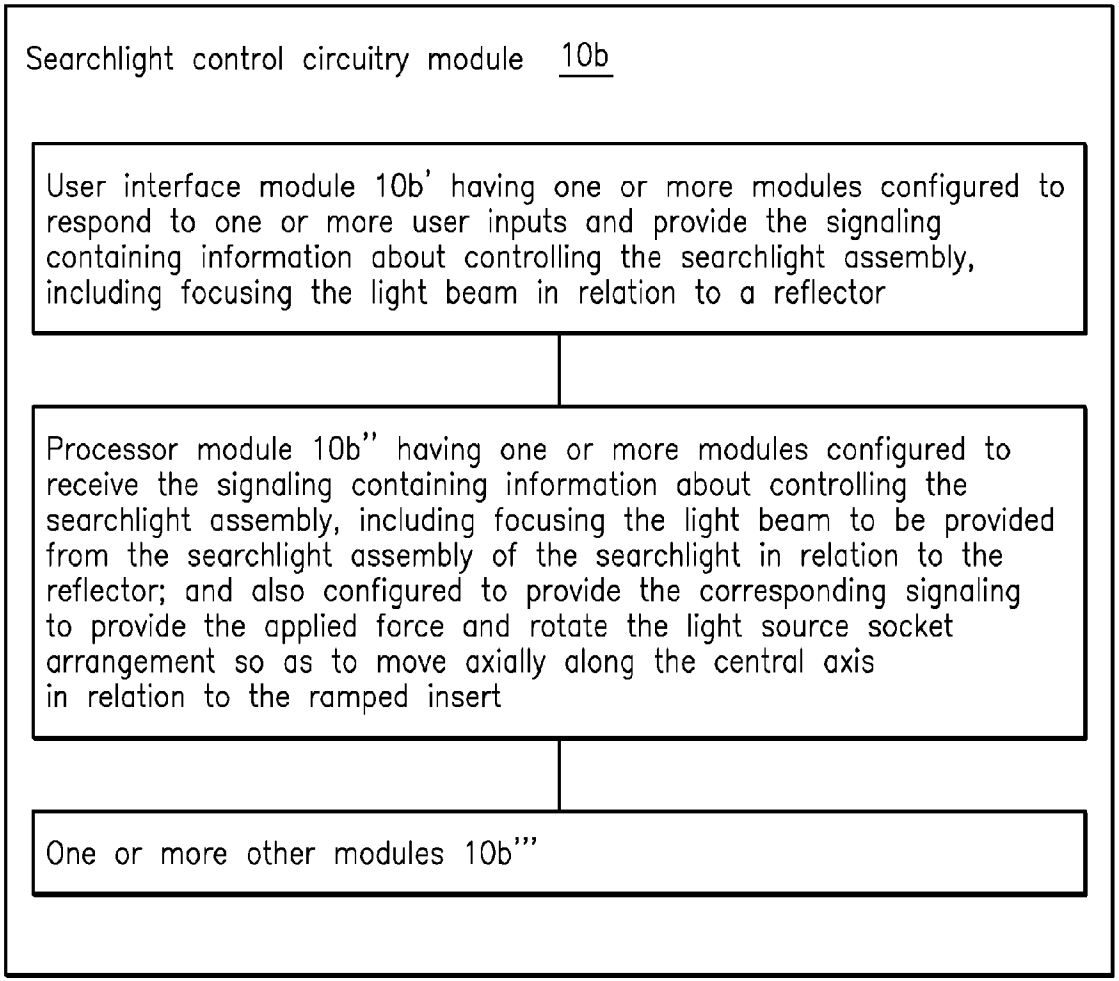
FIG. 1*d* show a block diagram of a searchlight control circuitry that forms part of the searchlight shown in FIG. 1 according to some embodiments of the present invention.

FIG. 1*d*: Searchlight Control Circuitry Module

FIG. 1*d* shows a new and unique searchlight control circuitry 10*b* featuring a user interface module 10*b*', a processor module 10*b*", and one or more other modules 10*b*'", according to some embodiments of the present invention.

The user interface module 10*b*' includes one or more modules configured to respond to one or more user inputs and provide the signaling containing information about focusing the light beam.

The processor module 10*b*" includes one or more modules configured to receive the signaling containing information about controlling the searchlight assembly, including focusing the light beam to be provided from the searchlight assembly 10*a* of the searchlight 10, where the searchlight assembly includes features consistent with that set forth above; and also configured to provide the corresponding signaling to provide the applied force and rotate the light source socket arrangement 12, 16 (FIGS. 1*a*, 1*b*) so as to move axially along the central axis 22 (FIGS. 1*a*, 1*b*) in relation to the ramped insert 14 (FIGS. 1*a*, 1*b*), e.g. including for focusing the light beam to be provided from the searchlight assembly 10*a* of the searchlight 10 in relation to the reflector 20.

The one or more modules may be configured to receive the signaling from a control module of a searchlight controller, according to some embodiments of the present invention. The one or more modules may also be configured to provide the corresponding signaling to the control module of the searchlight assembly, and/or the corresponding signaling comprises a signal for controlling a motor that forms part of the searchlight assembly, according to some embodiments of the present invention.

By way of example, and consistent with that described herein, the functionality of the one or more modules of the user interface module 10*b*' and the processor module 10*b*" may be implemented using hardware, software, firmware, or a combination thereof, although the scope of the invention is not intended to be limited to any particular embodiment thereof. In a typical software implementation, the one or more module would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology now known or later developed in the future. Moreover, the scope of the invention is intended to include the one or more modules being a stand alone modules, as shown, or in the combination with other circuitry for implementing another module.

The one or more other modules 10*b*'" may perform other functionality related to the searchlight that does not form part of the underlying invention and is thus not described in detail herein.

Figure 2A:
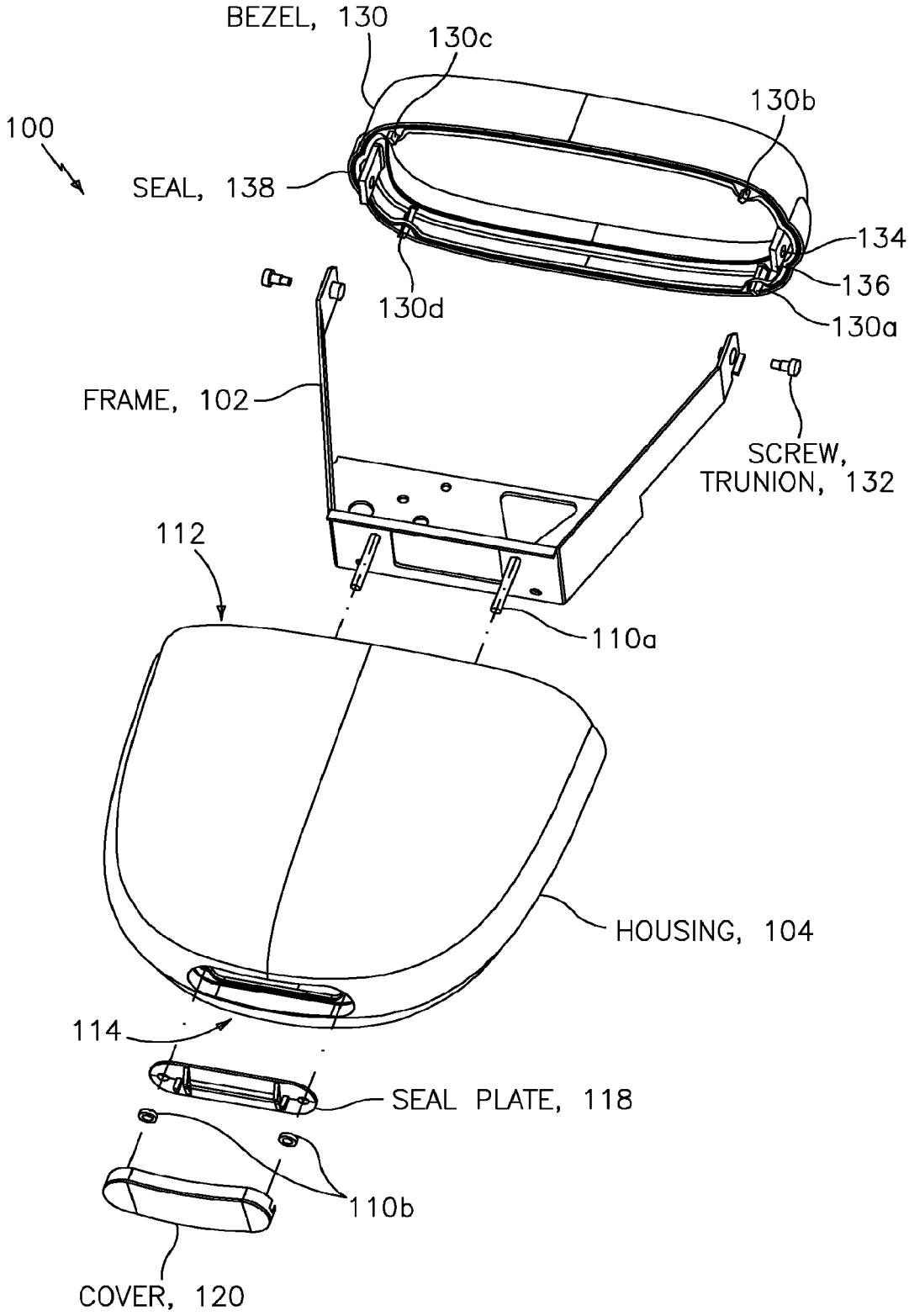
FIG. 2*a* shows another exploded view of a frame, a housing, a seal plate, a cover, nuts and bolts and a bezel that form part of a searchlight assembly of a searchlight according to some embodiments of the present invention.
Figure 2B:
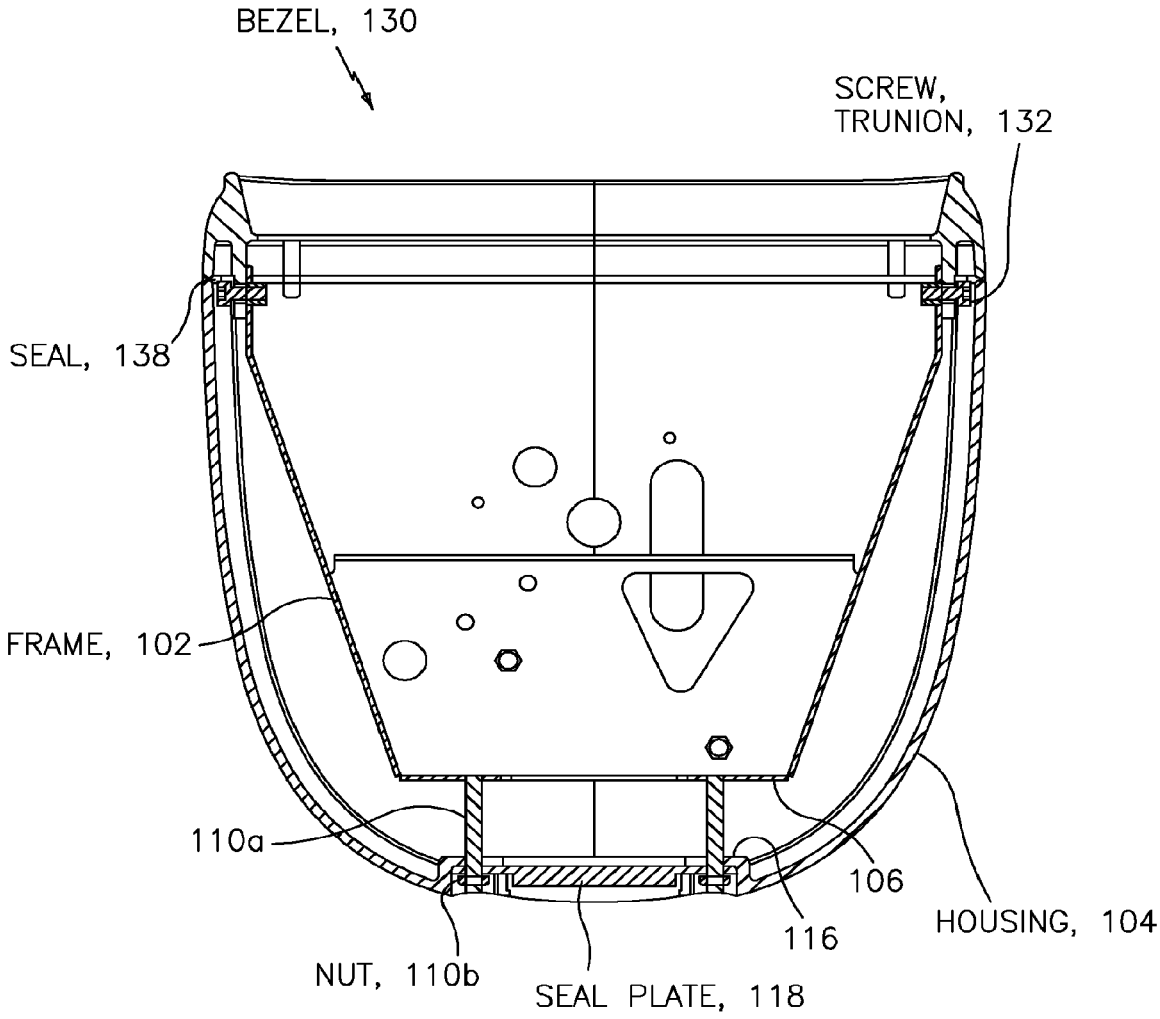
FIG. 2*b* shows a cross-sectional view of a frame, a housing, a seal plate, a cover, nuts and bolts and a bezel, when assembled together, that form part of a searchlight assembly of a searchlight according to some embodiments of the present invention.

FIGS. 2*a*, 2*b*: Pull-In Bezel Retention

FIGS. 2*a*, 2*b* show a pull-in bezel retention system 100 that may form part of the searchlight 10 (FIG. 1) according to the present invention.

The pull-in bezel retention system 100 features a frame 102 and a housing 104. The frame has a back plate 106 configured with at least one opening 108 to receive a fastening device 110*a*, 110*b*. The housing 104 is configured with a front end opening generally indicated as 112 for receiving the frame 102, configured with a back end opening 114 having an outer rim 116 for receiving a seal plate 118, the seal plate 118 configured to be adapted in the outer rim 116 of the back end opening 114, to receive the fastening device 110*a*, 110*b* and to fixedly couple the frame 102 to the housing 104. The pull-in bezel retention system 100 includes a cover 120 configured to be arranged in the back end opening 114. FIG. 2*b* shows the pull-in bezel retention system 100 as assembled.

In effect, the pull-in bezel retention system 100 retains a bezel 130 and lens without the use of visible fasteners, i.e. that is fasteners that can be seen from the outside once the system 100 is assembled. The bezel 130 is connected solidly to the frame 102 that forms a rigid, internal motor chassis by passing screws 132 through openings 134 in bezel tabs 136, and that is pulled into the housing 104 via the threaded studs 110*a* and nuts 110*b* located in a pocket or well at the Aft end of the housing 104 (See FIG. 2*a*). By tightening the retainer nuts 110*b*, the frame or chassis 102 is pulled aft, compressing the Bezel 130 against a water-tight seal 138 at the forward interface with the main housing. The bezel 130 and housing 104 contain aligning features generally indicated as 130*a*, 130*b*, 130*c*, 130*d* for relative location, but no fasteners. Typically marine searchlights include a badge at the aft end, so the cover or coverplate can easily be used to hide the bezel retaining nuts or fasteners 110*b* (See FIG. 2*b*).

Figure 3A:
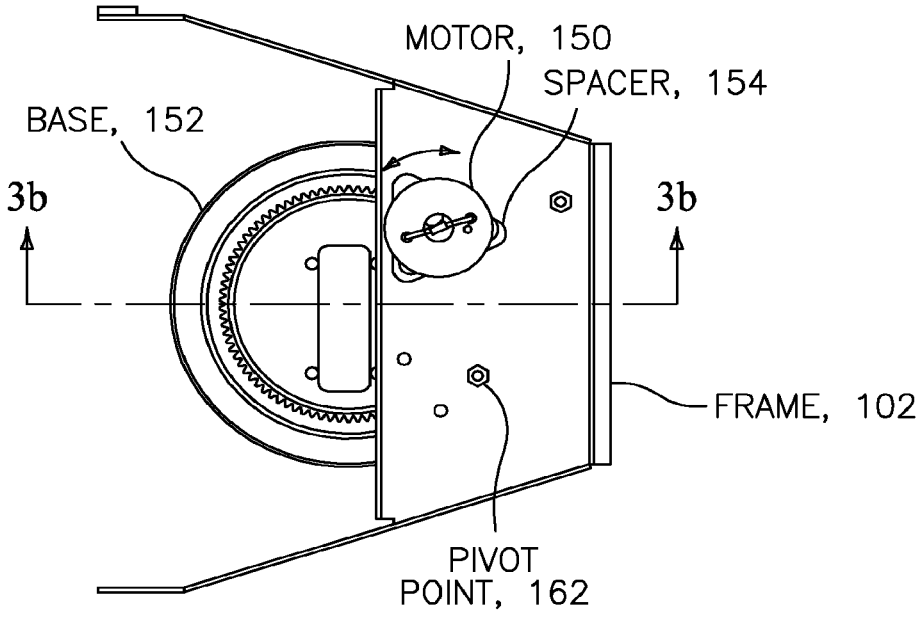
FIG. 3*a* shows a top-down view of a frame, a motor, and a base that form part of a searchlight assembly of a searchlight according to some embodiments of the present invention.
Figure 3B:
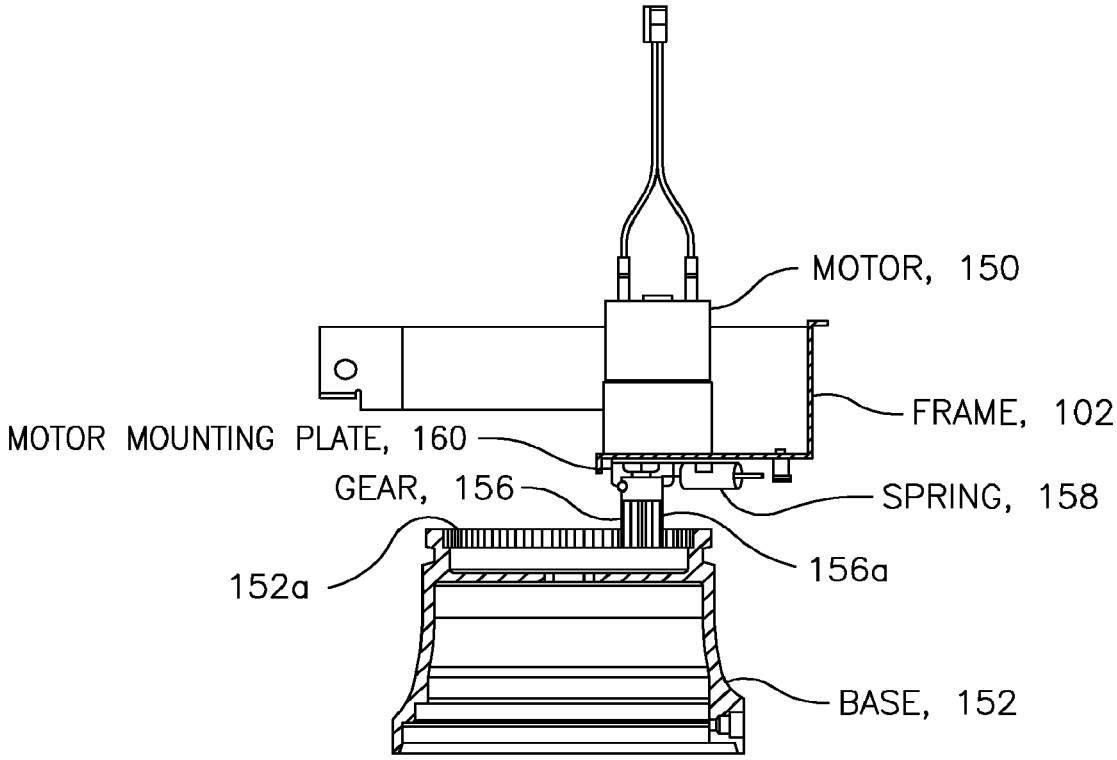
FIG. 3*b* shows a cross-sectional view along lines 3*b*-3*b* of that shown in FIG. 3*a* according to some embodiments of the present invention.

FIGS. 3*a*, 3*b*: Spring-Loaded Scan Motor

FIGS. 3*a* and 3*b* show an arrangement having a spring-loaded scan motor or gearmotor 150, a base 152, one or more spacers 154, a pinion gear 156, a spring 158 and a mounting plate 160 that forms part of the frame 102 according to some embodiments of the present invention. The base 150 has a stationary ring gear or teeth 150*a* that are coupled to the teeth 156*a* of the pinion gear 156 in order to rotate the frame 102 in relation to the base 150 when the spring-loaded scan motor 150 rotates the gear 156.

In operation, the spring 158 is coupled between a pivot point 162 of the frame 102 and the motor 150 and used to hold the gearmotor 150 with the pinion gear 156 against the stationary ring gear or teeth 156*a* for the purpose of actuating horizontal motion of the frame 102 in relation to the base 150.

The benefits of this solution include:

1. Enables the use of the pull-in bezel retention system 100 (FIGS. 2*a*-2*d*) described above by accommodating variability in positioning of the motor chassis; and thus variability in position of drive pinion relative the mating ring gear 152*a*.

2. Allows for economical fabrication of product by easing manufacturing tolerances on components and/or eliminating tedious adjustments during final assembly.

3. Minimizes "backlash" in the scan motion gear train; and maintains perfect engagement between the drive pinion 156 and the stationary ring gear 152*a*. It is well known that users are typically dissatisfied with any perceived looseness in the scan gear drive system.

Figure 4A:
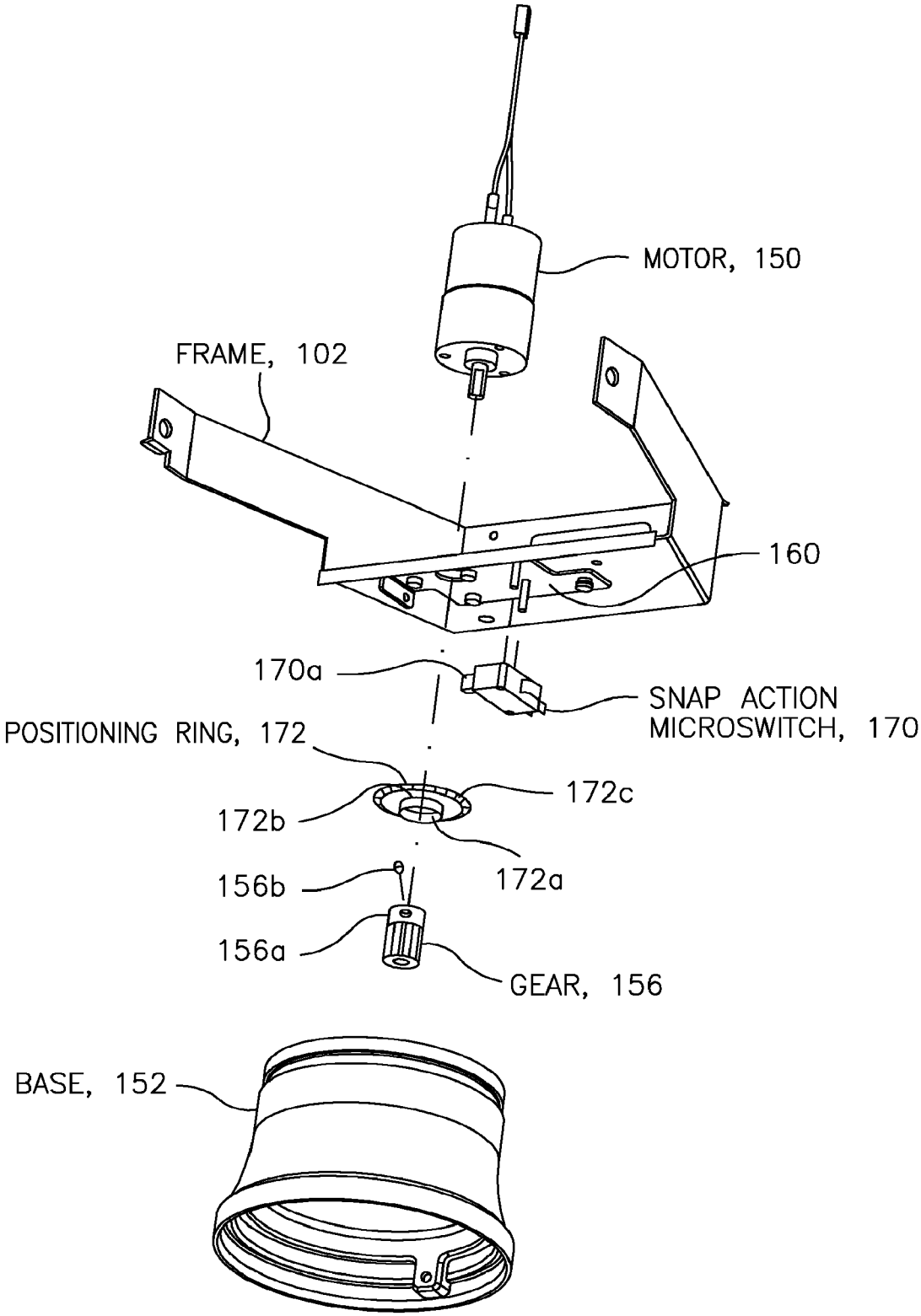
FIG. 4*a* shows an exploded view of a frame, a motor, a snap-action microswitch, a positioning ring, a gear and a base that form part of a searchlight assembly of a searchlight according to some embodiments of the present invention.
Figure 4B:
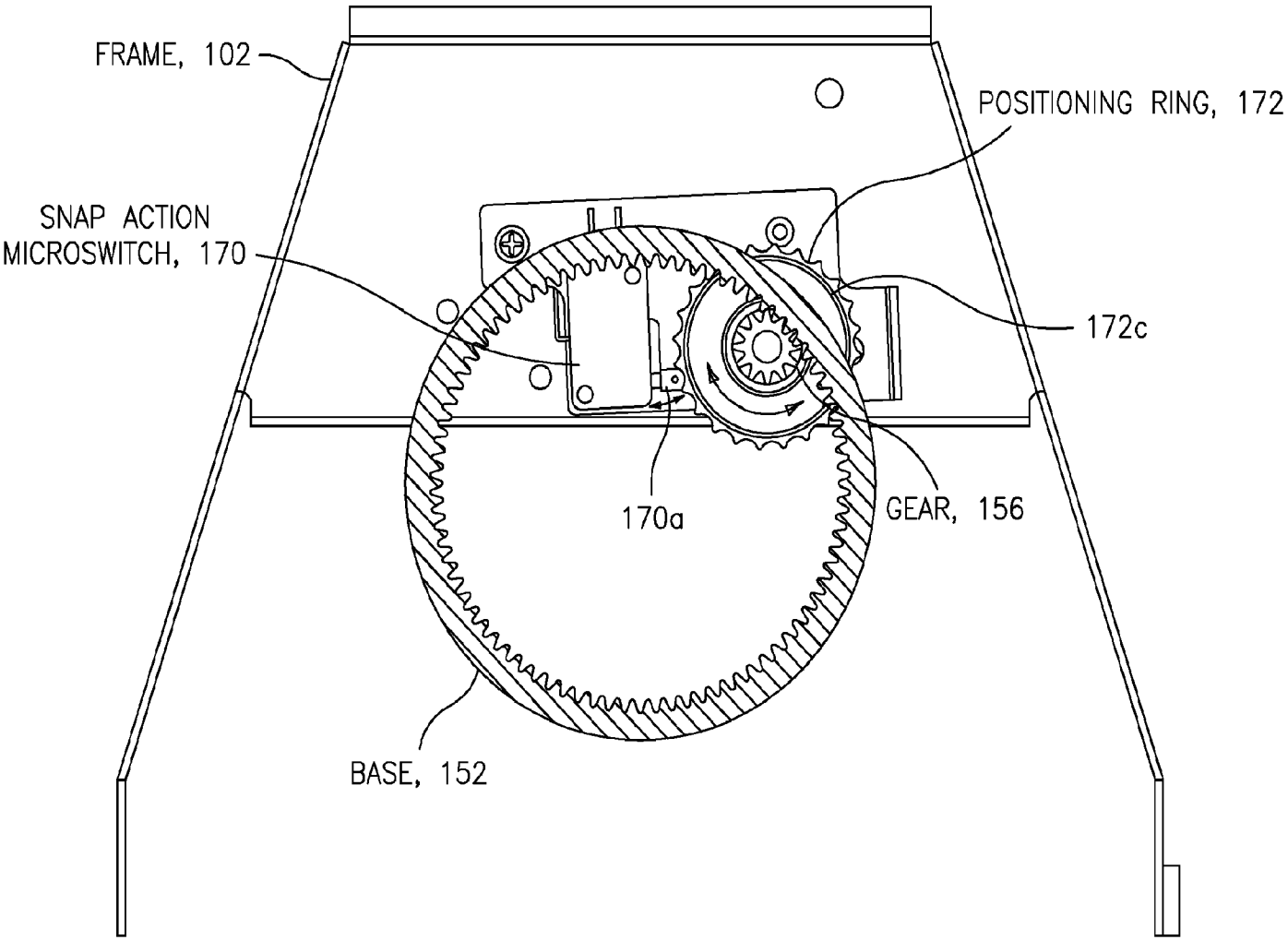
FIG. 4*b* shows a view of the frame, the motor, the snap-action microswitch, the positioning ring, the gear and the base shown in FIG. 4*a* as assembled according to some embodiments of the present invention.

FIG. 4*a*, 4*b*: Beam Sweep Mechanism

FIGS. 4*a*, 4*b* show an arrangement for a beam sweep mechanism for a searchlight according to some embodiments of the present invention.

The beam sweep mechanism for marine searchlights involves sweeping the beam right and left of a center point to allow illumination of channel markers or hazards on each side of the craft. A common failure mode of this feature in the prior art searchlight(s) occurs when open-loop controllers allow the beam "drifts" off-center over time. Numerous closed-loop systems have been proposed to eliminate this problem, but are invariably expensive not robust enough for marine applications.

FIGS. 4*a* and 4*b* show the beam sweep mechanism that is a positioning mechanism for automated beam sweeping, which uses a robust counter arrangement to implement the beam sweep feature. For example, the counter arrangement may include a snap-action microswitch 170 in combination with a position ring 172. The position ring 172 has a collar 172*a* with a recess 172*b*. The gear 156 has a cylindrical surface 156*a* for receiving a fastener 156*b*. The snap sensor or snap-action microswitch 170 is coupled to the position ring 172 by sliding the collar 172*a* over the cylindrical surface 156*a*, and inserting the fastener 156*b* into the recess 172*b*. The positioning ring or toothed wheel 172 has circumferentially arranged teeth 172*c*.

In operation, the snapswitch sensor or snap-action microswitch 170 has a projecting member 170*a* that rides on the circumferentially arranged teeth 172*c* of the positioning wheel or toothed wheel 172 to send a contact-closure signal containing closed-loop position data back to a digital controller, which forms part of the snapswitch sensor or snap-action microswitch 170. Using an open-loop control, this arrangement or system can accurately track the position of the searchlight; allowing continued scanning while eliminating beam drift over time. No marine searchlights have been known to implement this rugged, simple, solution.

Snapswitch sensor or snap-action microswitches like 170 are known in the art and the scope of the invention is not intended to be limited to any particular type or kind thereof, either now known or later developed in the future.

Wireless Control for Improved Slip Ring Reliability

For high-end searchlights, users or customers have a preference for improved reliability of 360 degree motion. This is particularly important for workboats and search-an-rescue where beam spotting may be needed anywhere around the craft. All known solutions involve slip-rings (sliding contacts) to bring electrical power and control signals from the stationary assembly to the moving assembly in the searchlight. It has been shown that low-level signals such as motors and control signals exhibit poor reliability when brought across a slip ring.

Separately, wireless control is known for marine searchlights. It has been implemented in a number of models for the purpose of improving convenience and cost.

However, the new searchlight according to some embodiments of the present invention appears to be the first to implement 360 degree motion and radio frequency (RF) communication in tandem. RF communication is selected for the purpose of reducing the number of conductors that need sliding contacts to implement 360 degree motion. The new searchlight requires only two sliding contacts (Power + and −), with all other control signals communicated wirelessly.

8-Way Beam Pointing Using Wireless Control

Customers or users have shown a preference for 8-way control of beam pointing. With 8-way control, the searchlight can be pointed not only Right-Left and Up-Down, but simultaneously Left-Up, Right-Down, etc. Wired controllers that implement this feature are well known. The searchlight according to the present invention features 8-way pointing using a wireless controller.

SCOPE OF THE INVENTION

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

We claim:

1. A searchlight comprising:

a searchlight assembly having a central axis, and having a ramped insert configured with an angled surface that is oblique in relation to the central axis, and a light source socket arrangement configured to receive a bulb or light source for providing a light beam, configured with a corresponding angled surface that is also oblique in relation to the central axis, and also configured to respond to an applied force and rotate so as to move axially along the central axis in relation to the ramped insert; and a searchlight control circuitry module having one or more modules configured to receive signaling containing information about controlling the searchlight assembly, including focusing the light beam to be provided from the searchlight assembly of the searchlight; and also configured to provide corresponding signaling to provide the applied force and rotate the light source socket arrangement so as to move axially along the central axis in relation to the ramped insert.

2. A searchlight according to claim 1, wherein the light source socket arrangement is configured to include a bulb or light source socket and a ramped collar, including some combination of the bulb or light source socket being fixedly coupled to the ramped collar, or the ramped collar being configured with the corresponding angled surface, or the bulb socket being configured to receive the bulb or light source and also to respond to the force.

3. A searchlight according to claim 1, wherein the searchlight assembly further comprises a reflector being arranged in relation to the ramped insert and the light source socket arrangement, such that the movement of the light source socket arrangement axially along the central axis in relation to the ramped insert focuses the light beam in relation to the reflector.

4. A searchlight according to claim 3, wherein the movement of the light source socket arrangement axially along the central axis in relation to the ramped insert causes the light source arrangement to move in relation to the reflector that enables the degree of focus of the light beam emanating from the bulb or light source to change by moving the light source arrangement in and out along the central axis of the reflector, including so as to provide progressive spot-to-flood focusing, and vice versa.

5. A searchlight according to claim 1, wherein, in response to the force, the corresponding angled surface of the light source socket arrangement is configured to slide in relation to the angled surface of the ramped insert causing the light source socket arrangement to move axially along the central axis in relation to the ramped insert.

6. A searchlight according to claim 1, wherein the searchlight further comprises a chassis, and the ramped insert is fixedly coupled to the chassis.

7. A searchlight according to claim 1, wherein the light source socket arrangement is configured to receive a transverse rotational force applied in relation to the central axis and move in an axial translation along the central axis.

8. A searchlight according to claim 1, wherein the searchlight assembly comprises a dual beam configuration, each comprising a respective ramped insert and a respective light source socket arrangement.

9. A searchlight according to claim 8, wherein the dual beam configuration further comprises a central actuator and linkage configured to focus two parallel beams simultaneously to position and synchronize respective light source socket arrangements in relation to respective ramped inserts.

10. A searchlight according to claim 1, wherein the one or more modules is configured to receive the signaling from a control module in a searchlight controller.

11. A searchlight according to claim 1, wherein the one or more modules is configured to provide the corresponding signaling to the searchlight assembly.

12. A searchlight according to claim 11, wherein the corresponding signaling comprises a signal for controlling a motor that forms part of the searchlight assembly.

13. A searchlight assembly having a central axis comprising:

a ramped insert configured with an angled surface that is oblique in relation to the central axis; and a light source socket arrangement configured to receive a bulb or light source for providing a light beam, configured with a corresponding angled surface that is also oblique in relation to the central axis, and also configured to respond to an applied force and rotate so as to move axially along the central axis in relation to the ramped insert.

14. A searchlight assembly according to claim 13, wherein the light source socket arrangement is configured to include a bulb or light source socket fixedly coupled to a ramped collar, where the ramped collar is configured with the corresponding angled surface, and where the bulb socket is configured to receive the bulb or light source and also to respond to the force.

15. A searchlight assembly according to claim 13, wherein the searchlight assembly further comprises a reflector being arranged in relation to the ramped insert and the light source socket arrangement, such that the movement of the light source socket arrangement axially along the central axis in relation to the ramped insert focuses the light beam in relation to the reflector.

16. A searchlight assembly according to claim 15, wherein the movement of the light source socket arrangement axially along the central axis in relation to the ramped insert causes the bulb or light source arrangement to move in relation to the reflector that enables the degree of focus of the light beam emanating from the bulb or light source to change by moving the bulb or light source arrangement in and out along the central axis of the reflector, including so as to provide progressive spot-to-flood focusing, and vice versa.

17. A searchlight assembly according to claim 13, wherein, in response to the rotational force, the corresponding angled surface of the light source socket arrangement is configured to slide in relation to the angled surface of the ramped insert causing the light source socket arrangement to move axially along the central axis in relation to the ramped insert.

18. A searchlight assembly according to claim 13, wherein the searchlight further comprises a chassis, and the ramped insert is fixedly coupled to the chassis.

19. A searchlight assembly according to claim 13, wherein the light source socket arrangement is configured to receive a transverse rotational force applied in relation to the central axis and move in an axial translation along the central axis.

20. A searchlight assembly according to claim 13, wherein the searchlight assembly comprises a dual beam configuration, each comprising a respective ramped insert and a respective light source socket arrangement.

21. A searchlight assembly according to claim 20, wherein the dual beam configuration further comprises a central actuator and linkage configured to focus two parallel beams simultaneously to position and synchronize respective light source socket arrangements in relation to respective ramped inserts.

22. A control circuitry module comprising:

one or more modules configured to:

receive signaling containing information about controlling a searchlight assembly, including focusing a light beam to be provided from the searchlight assembly of the searchlight, the searchlight assembly having a central axis and including:

a ramped insert configured with an angled surface that is oblique in relation to the central axis, and a light source socket arrangement configured to receive a bulb or light source for providing the light beam, configured with a corresponding angled surface that is also oblique in relation to the central axis, and also configured to respond to an applied force and rotate so as to move axially along the central axis in relation to the ramped insert; and provide corresponding signaling to provide the applied force in order to rotate the light source socket arrangement so as to move axially along the central axis in relation to the ramped insert.

23. A control circuitry module according to claim 22, wherein the one or more modules is configured to receive the signaling from a control module in a searchlight controller.

24. A control circuitry module according to claim 22, wherein the one or more modules is configured to provide the corresponding signaling to the searchlight assembly.

25. A control circuitry module according to claim 24, wherein the corresponding signaling comprises a signal for controlling a motor that forms part of the searchlight assembly.

* * * * *